US007420121B2

(12) United States Patent
Tezuka et al.

(10) Patent No.: US 7,420,121 B2
(45) Date of Patent: Sep. 2, 2008

(54) STRUCTURE FOR A CABLE CONNECTION HEAD

(75) Inventors: Kazuhiko Tezuka, Ichihara (JP); Yutaka Ohsaki, Tokyo (JP)

(73) Assignee: Japan Petroleum Exploration Co., Ltd., Tokyo (JP)

( * ) Notice: Subject to any disclaimer, the term of this patent is extended or adjusted under 35 U.S.C. 154(b) by 565 days.

(21) Appl. No.: 11/069,966

(22) Filed: Mar. 3, 2005

(65) Prior Publication Data

US 2005/0274514 A1 Dec. 15, 2005

(30) Foreign Application Priority Data

Jun. 10, 2004 (JP) ..... 2004-172200

(51) Int. Cl.
*H01R 9/05* (2006.01)

(52) U.S. Cl. ..... 174/74 R; 174/88 R

(58) Field of Classification Search ..... 174/74 R, 174/88 R; 166/254.2, 65.1, 384
See application file for complete search history.

(56) References Cited

U.S. PATENT DOCUMENTS 3,401,749 A * 9/1968 Daniel ..... 166/384
5,141,051 A * 8/1992 Lenhart ..... 166/65.1
7,114,563 B2 * 10/2006 Rose ..... 166/254.2

FOREIGN PATENT DOCUMENTS

JP 62-64080 3/1987

* cited by examiner

*Primary Examiner*—Chau N Nguyen
(74) *Attorney, Agent, or Firm*—Jacobson Holman PLLC

(57) ABSTRACT

To fill a cable connection head with an insulating oil and provide a movable lid member of the oil to ensure a long-term insulating property in the cable connection head and enable long-term continuous use of a measuring device.

A cable connection head 18 having a head body 21 comprised of a bottom head body 19 and a top head body 20 connected to a measuring device body 6, having a well logging cable 1 passed through the top head body 30, and having core conductors of sheathed cables 2 connected to a connector 11 fit into the bottom head body 19, wherein the bottom head body 19 is filled with a low viscosity insulating oil 29 with a specific gravity heavier than the borehole fluid, outflow of the low viscosity insulating oil 29 is prevented, and a movable sealing member 30 preventing entry of borehole fluid is provided movably inside the bottom head body 19.

3 Claims, 7 Drawing Sheets

【FIG. 1】
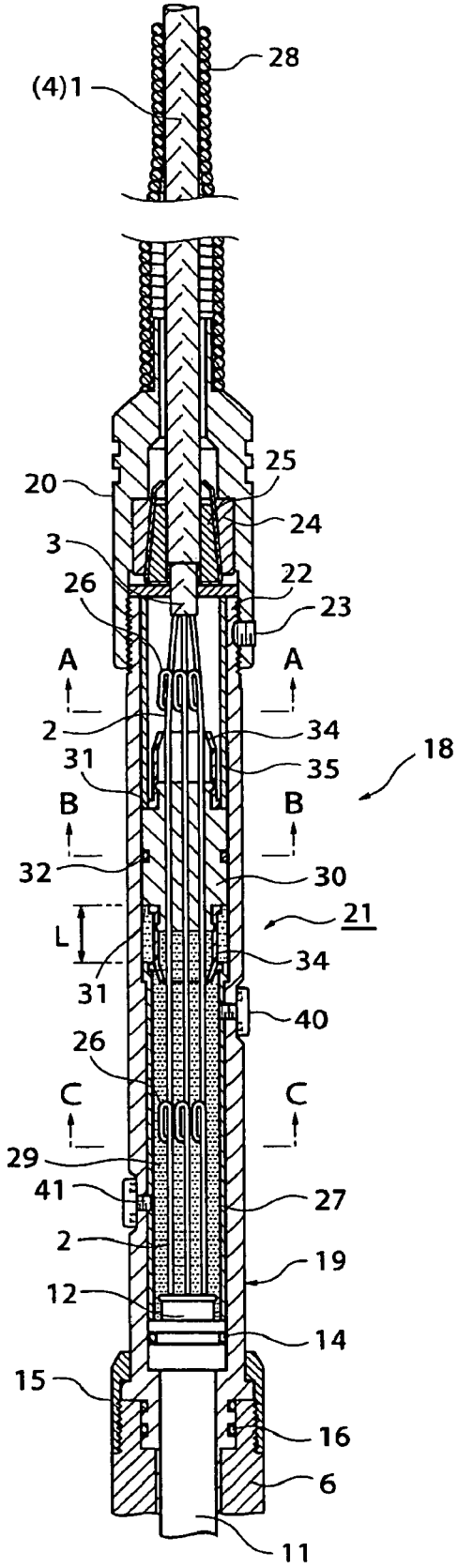

【FIG. 2】
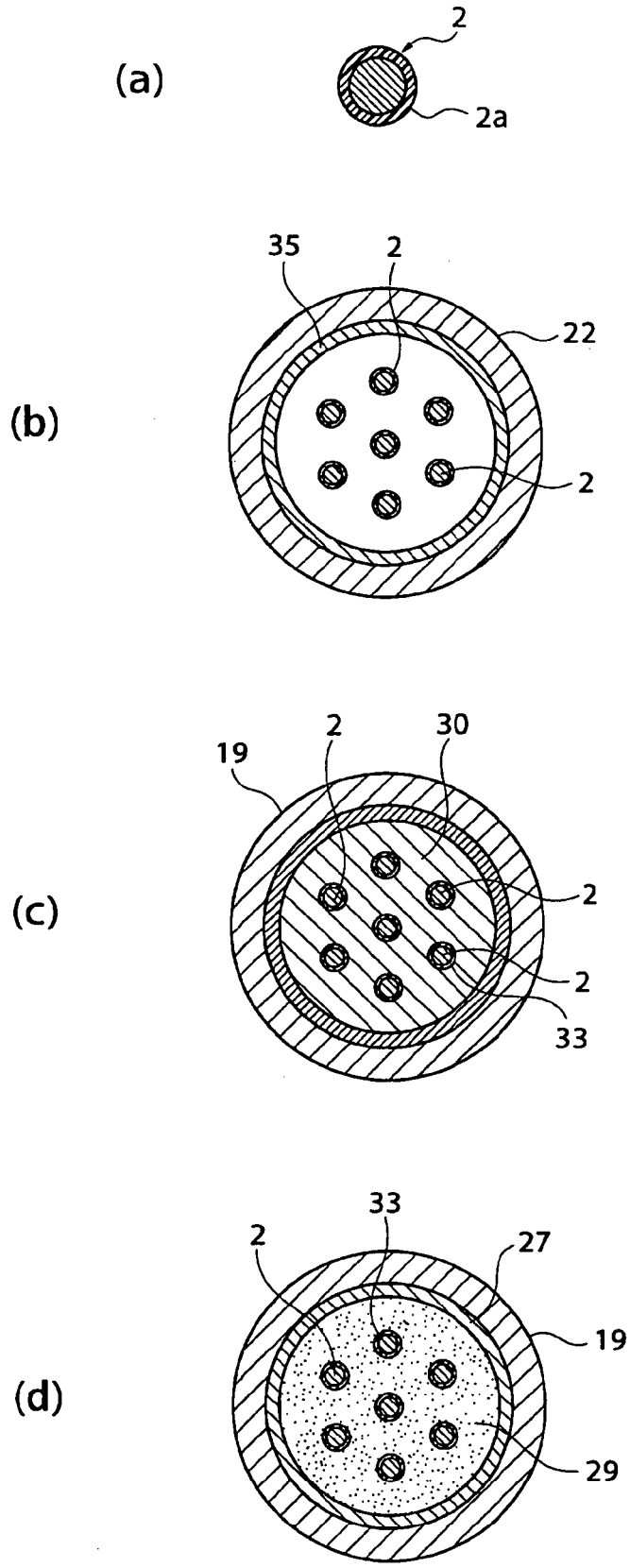

【FIG. 3】
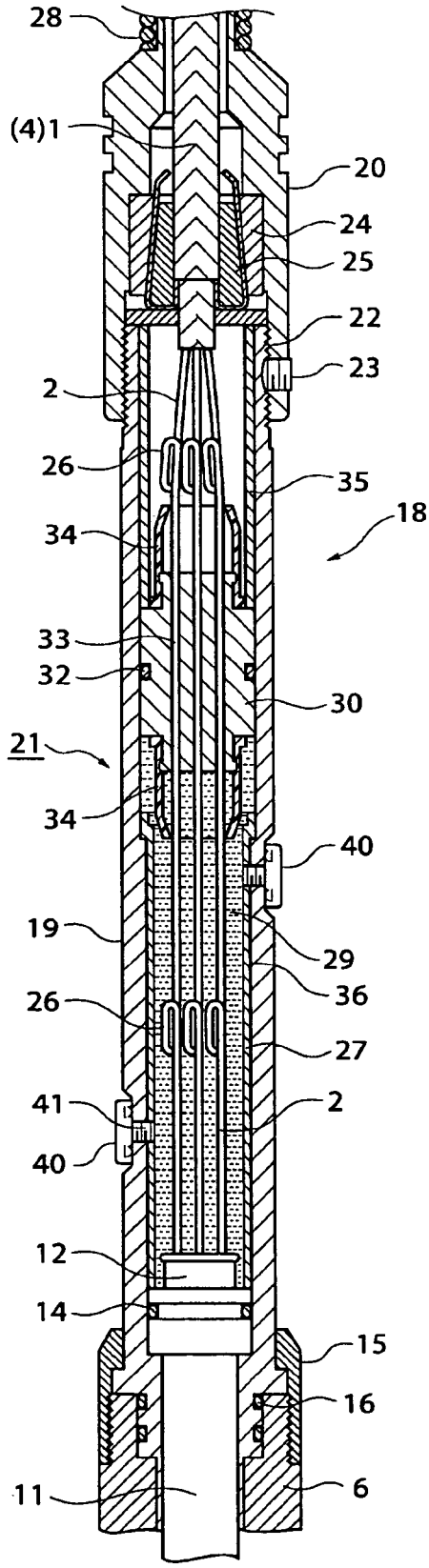

【FIG. 4】
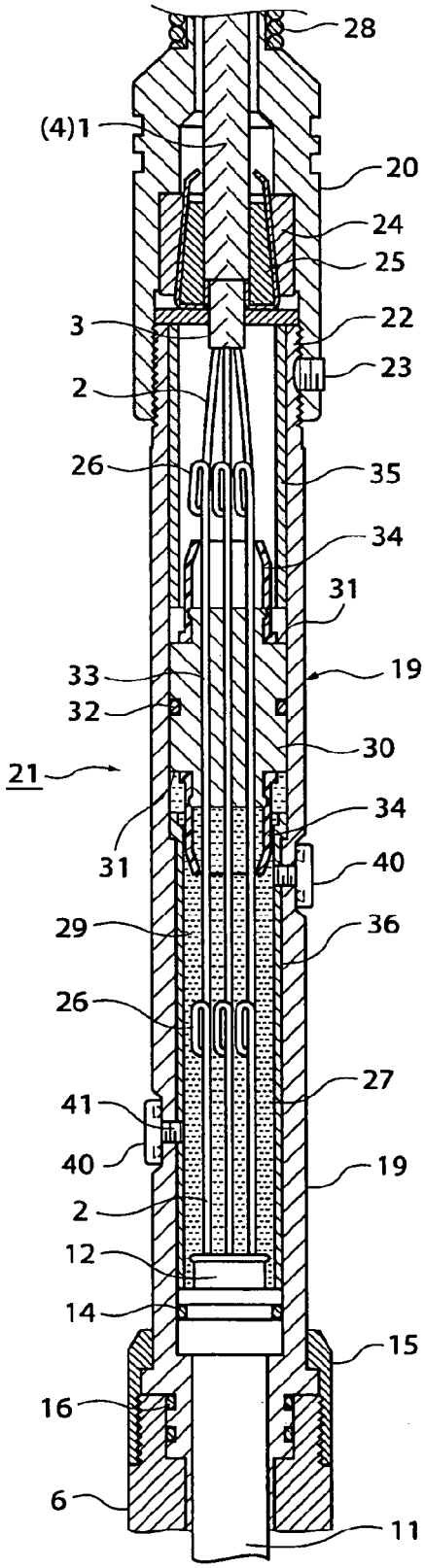

【FIG. 5】
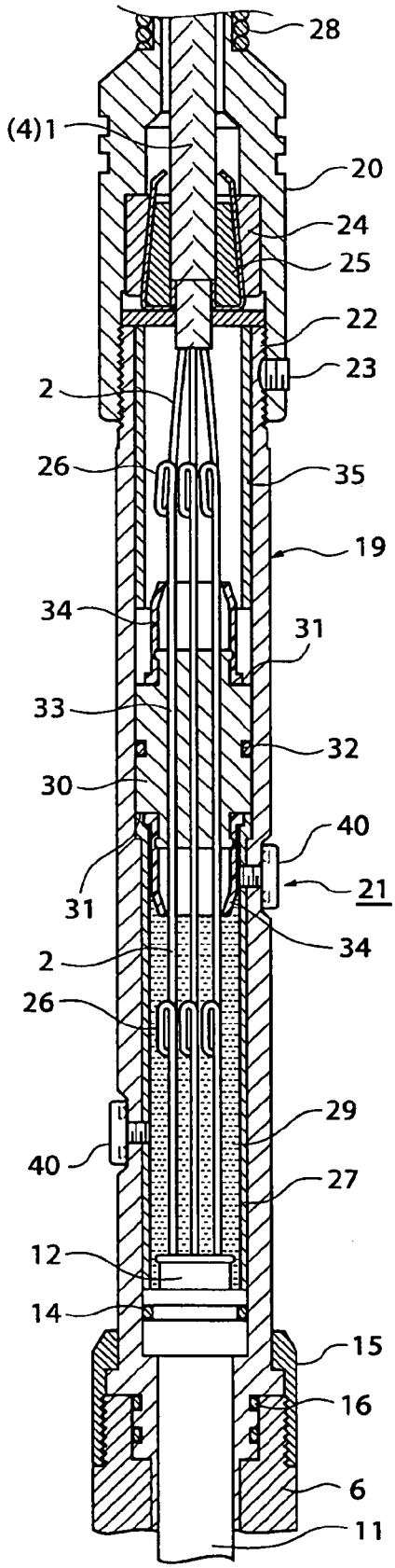

【FIG. 6】
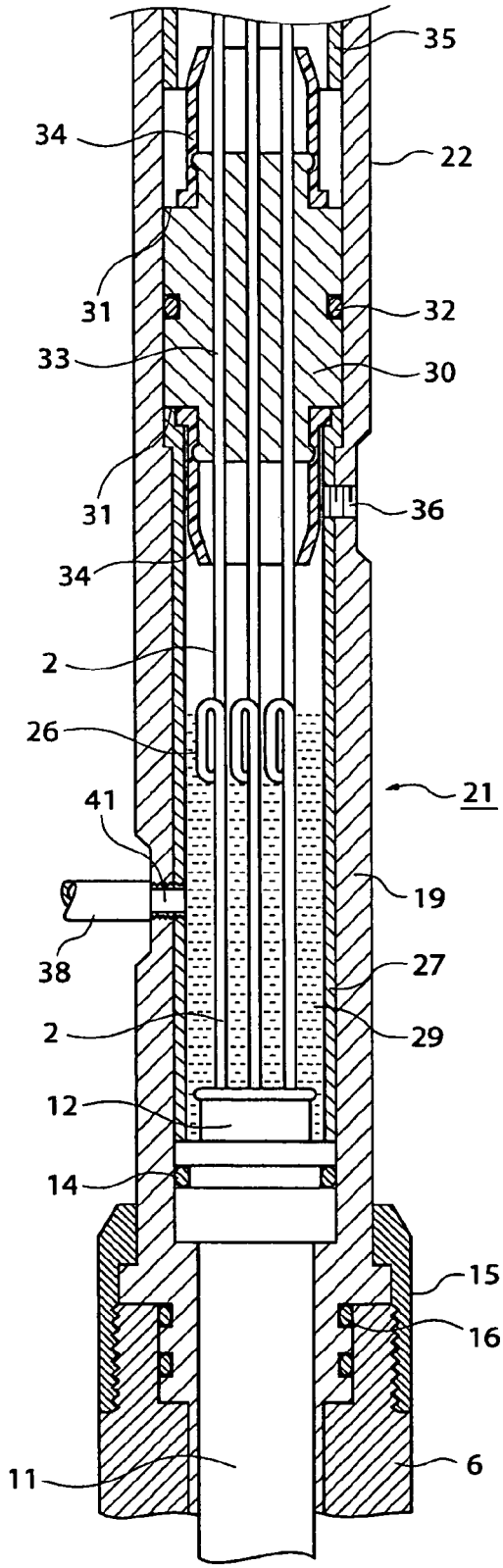

【FIG. 7】
PRIOR ART
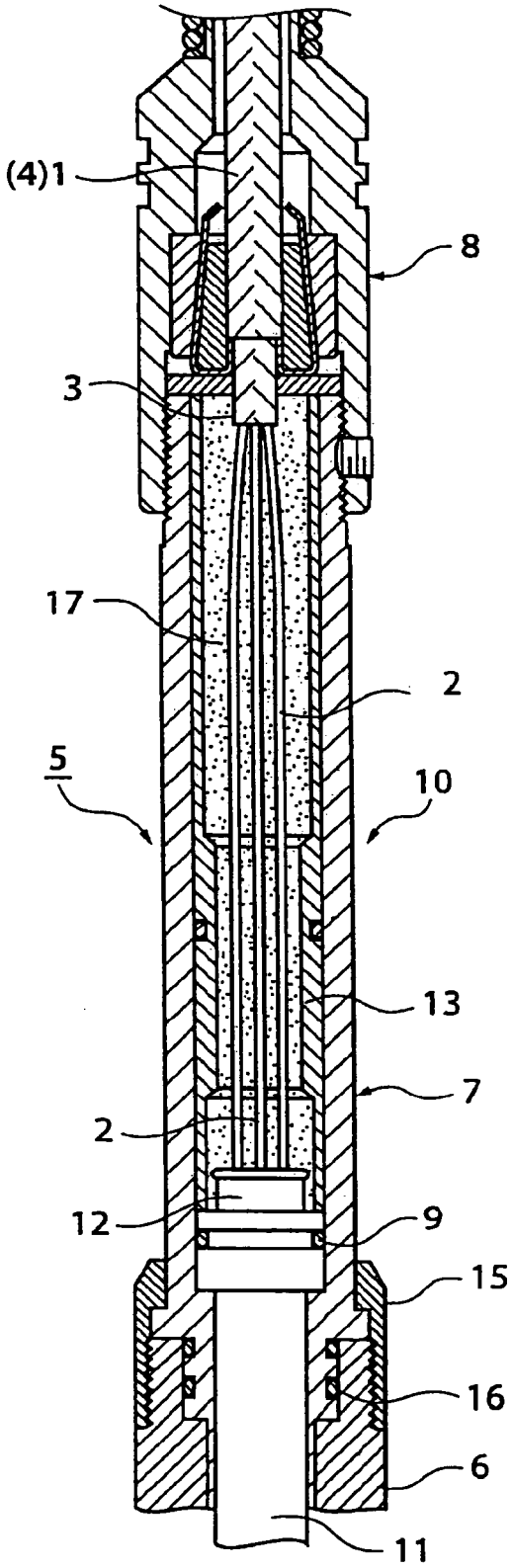

STRUCTURE FOR A CABLE CONNECTION HEAD

TECHNICAL FIELD

The present invention relates to a high temperature use cable connection head connecting a well logging cable and a measuring device when lowering various types of measuring devices into an oil well, geothermal well, or other well.

PRIOR ART

In an oil well or geothermal well, physical properties of the underground layer such as the temperature, pressure, seismic wave speed, and earthquakes and other vibration are measured by temperature and pressure well logging, electrical well logging, acoustic well logging, or the like and output characteristics by flow rate well logging etc. are measured using measuring devices in many cases. When making these measurements, various measuring devices (well logging sondes) are connected to cables and lowered into the borehole and the temperature, pressure, earthquake, and other measurement data measured at an underground depth are sent by signals to the ground through cables. In this case, a cable connection head is used for the part mechanically and electrically connecting the cable and measuring device. In the past, the cable head used in measurement of oil or geothermal energy is designed for easy connection and detachment of the device and cable.

A cable connection head is comprised of the following three basic components, that is, (1) a terminal section of armor steel wires in a well logging cable, (2) a part introducing the sheathed cables of the well logging cable to the cable head body, and (3) a part connecting with the measuring device. Among these, the part introducing the sheathed cables of the well logging cable to the head body is the most important and difficult part.

As prior art of the cable connection head of the above applications, there is the structure such as shown by a general sectional view of FIG. 7. That is, the well logging cable 1 in the cable connection head 5 has glass fiber or another insulating material interposed between the large number of sheathed cables 2 covered by Teflon (registered trademark) fibers and has holding tape covering the Teflon (registered trademark) sheathed cables 2 and glass fibers and other insulating materials wrapped around them to form a sheathed cable 3. A large number of armor steel wires 4 are wrapped around the outside of the sheathed cable 3.

The cable connection head 5 is provided with a head body 10 comprised of a bottom head body 7 connected to the top of the measuring device body 6 and a top head body 8. The top head body 8 has armor steel wires 4 of the well logging cable 1 fixed to it. The bottom end of the bottom head body 7 has a connector 11 having a large number of connector terminals fixed to it. The core conductors exposed from the sheathed cables 2 are connected to a terminal section 12 of the connector 11. The inside surface of the bottom head body 7 is provided with a sleeve 13. To prevent the entry of water into the measuring device body 6, an O-ring 9 fit into the groove at the outer circumference of the head of the connector 11 is pressed against the inner surface of the bottom head body 7.

The bottom end of the bottom head body 7 has a coupling 15 having a female thread fit over it rotatably and unable to be pulled off downward. The coupling 15 is screwed with the measuring device body 6 holding the connector 11 and fit with the bottom end of the bottom head body 7 through an O-ring 16.

The closed space inside the head body formed at the inside of the top and bottom head bodies 8 and 7 and the sleeve 13 and having the sheathed cables 2 of the well logging cable 1 arranged in it is filled with grease 17. This grease prevents the entry of borehole fluid into the closed space. The closed space formed by the top and bottom head bodies 8 and 7 is not so completely sealed as to enable prevention of entry of borehole fluid, so borehole water enters the closed space along with the elapse of time. If borehole water enters the closed space, it reaches the metal part (terminal section 13) of the connector 11 and becomes a cause of poor insulation of the core conductor connection part and corrosion of the metal connection part.

To prevent this trouble, in the past, the closed space has been filled with a high temperature use grease (hereinafter referred to as simply "grease") 17. This grease 17 prevented the entry of borehole water etc. into the closed space and prevented the core conductors in the sheathed cables 2 and metal part of the connector 11 positioned in the closed space from being corroded by sea water or other borehole fluid.

However, the grease 17 generally has a high viscosity. When filling it into the closed space formed by the top and bottom head bodies 8 and 7 using a grease gun, the grease inevitably has various sized separate air bubbles entrained in it. These air bubbles move to the surface parts along with the elapse of time and form continuous air bubbles to thereby form channels connecting the inside and outside. The borehole fluid passes through these channels to reach the core conductors inside the sheathed cables 2 and the metal part of the connector 11 and cause poor insulation or corrosion.

To deal with this problem, in well logging in boreholes etc., since the measurement ends in a relatively short time (maximum 12 hours or so), an insulation drop was prevented by replacing the grease in the cable connection head with every measurement.

However, when using a conventional cable connection head and conducting measurement for a long period (three months or more), frequently data could no longer be measured after about two months. When investigating the cause, it was found that the borehole water reached the metal part of the connector (core conductor connection part) and caused poor insulation and corrosion of the metal connection part. This, as explained above, is believed to be due to the air bubbles entrained in the grease moving to the surfaces of the sheathed cables to form continuous channels and over time enabling the borehole water to reach the connector metal connection part in the cable connection head through the slight clearances (channels) at the interfaces of the surfaces of the sheathed cables of the well logging cable and the grease.

As other prior art of this type, there is the art disclosed in Japanese Patent Publication (A) No. 62-64080.

[Patent Document 1] Japanese Patent Publication (A) No. 62-64080

DISCLOSURE OF THE INVENTION

Problems to be Solved by the Invention

As the role of a cable connection head, reliable insulation of the core conductors led out from the plurality of sheathed cables (signal lines) bared from the well logging cable is sought. Therefore, with the method of filling grease into the closed space in the conventional head body so as to prevent entry of borehole fluid into the head body, along with long, continuous use of the measuring device, the water or other borehole fluid passes through the slight clearances (channels) inevitably formed at the interfaces of the grease and sheathed cables to reach the connector metal section in the cable connection head resulting in a drop in electrical insulation of the core conductors led out from the sheathed cables and corrosion of the metal connection part etc. and inability of transmission of signals to the ground.

In particular, with a high temperature well (for example, 150° C., 200° C., or higher), high temperature use grease has been filled in the space of the sheathed cable part to prevent an insulation drop, but it is learned that when about three months at the most pass, water enters the head body and the insulation property is lost.

The present invention solves this problem of the prior art by filling a generally low viscosity oil as an insulating material into the cable connection head instead of the above-mentioned grease.

In the above, the low viscosity, smooth oil flows to the outside, so a lid member becomes necessary. In the present invention, a lid member is provided. Further, at a borehole depth of several thousand meters below the ground, the pressure due to the borehole fluid becomes extremely high. That is, at the boundary of the lid member, an extremely large pressure difference occurs between the bottom side of the lid member at the insulating oil filled side and the top side of the lid member at the borehole fluid side. The strength of the lid member is not enough to withstand this pressure. Further, if a large pressure difference occurs above and below the lid member, the pressure difference causes the borehole fluid to pass through the clearance between the lid member and the cable head body or the clearance between the lid member and sheathed cables and reach the connector metal section (core conductor connection part) in the cable connection head filled with the oil and become a cause of poor insulation and corrosion of the metal connection part.

In the present invention, the object is to simultaneously secure the strength of the lid member and solve the problem of poor insulation due to entry of borehole fluid by designing the lid member to be able to move in the head body along with a large pressure difference occurring above and below the lid member and thereby no longer requiring the lid member to be able to withstand a large pressure, that is, enabling the lid member to move by the pressure difference between the top and bottom and thereby the strength of the lid member to be secured and eliminating the possibility of the borehole fluid entering the location where the oil is filled by the pressure difference above and below the lid member.

Means for Solving the Problems

To solve the above problems, the present invention is configured as follows:

A first aspect of the invention is a structure of a cable connection head where a head body is formed in which a bottom head body connected to a measuring device body and a top head body into which a well logging cable is introduced form a closed space and in which cores led out from the sheathed cables of the well logging cable are fixed to the bottom head body, wherein said bottom head body houses an insulating oil preventing entry of borehole fluid and is provided with a movable sealing member preventing the insulating oil from flowing out, and the movable sealing member is designed to be able to move in the bottom head body together with the sheathed cables passing through the movable sealing member in the axial direction due to the pressure difference above and below the sealing member.

A second aspect of the invention is characterized in that said insulating oil is a low viscosity insulating oil with a specific gravity heavier than the borehole fluid.

A third aspect of the invention is characterized in that said movable sealing member has an O-ring sliding along the inside surface of the head body fit into it.

A fourth aspect of the invention is characterized in that said movable sealing member has a cylindrical boot through which the sheathed cables pass fixed to it and in that said cylindrical boot is designed to slide along the inner circumference of a sleeve arranged at the inside of the head body.

Effect of the Invention

The structure of the cable connection head according to the present invention uses as an insulating material a smooth insulating oil with a generally low viscosity instead of a high viscosity grease where air bubbles are easily entrained and where channels are formed for the entry of borehole fluid into the bottom head body, so when filling the insulating oil into the bottom head body, no air bubbles are liable to be entrained in the insulating oil. Therefore, the borehole fluid is not liable to enter into the bottom head body even with long, continuous use of the measuring device, the insulating property of the core conductors of the sheathed cables will not drop, and it is possible to eliminate any possibility of corrosion of the connector metal section in the cable connection head.

The low viscosity, smooth insulating oil according to the present invention flows to the outside, but in the present invention, leakage can be prevented by the movable sealing member (that is, the lid member). In particular, at a borehole depth of several thousand meters, an extremely large pressure difference occurs between the bottom side of the movable sealing member at the oil filled side and the top side of the movable sealing member at the borehole fluid side. Due to this, the movable sealing member would presumably have to be made stronger and borehole fluid would possibly penetrate past the movable sealing member. In the present invention, however, the movable sealing member can move in the head body due to the pressure difference, so the movable sealing member may be constructed even not being able to withstand a large pressure. Further, the pressure difference above and below the movable sealing member falls along with the movement, so it is possible to prevent the borehole fluid from reaching the location of the connector metal section at the bottom side of the movable sealing member over a long term.

Bext Mode for Working the Invention

Below, embodiments of the present invention will be explained with reference to the drawings.

FIG. 1 is a longitudinal sectional view of a cable connection head according to an embodiment of the present invention, FIG. 2(*a*) is a sectional view of a sheathed cable, and FIGS. 2(*b*), (*c*), and (*d*) are sectional views along A-A, B-B, and C-C of FIG. 1. FIG. 3, FIG. 4, and FIG. 5 are enlarged views of FIG. 1 showing states where the movable sealing member is displaced up, to the middle, and down. FIG. 6 is a sectional view of the state with the cable connection head filled with an insulating oil. In the figures, the example is shown of filling an insulating oil in the state with the cable connection head vertically stood up.

The explanation will be made here referring to the drawings. Note that the explanation will be given assigning common notations to common components.

The cable connection head 18 is connected to various types of measuring devices (well logging sondes) designed to be lowered to a depth of several thousand meters below the surface along the borehole. It is provided with a bottom head body 19 connected to a top part of a measuring device body 6 and a top head body 20 connected to the bottom head body 19. The top and bottom head bodies 19 and 20 are connected at the mating connection part 22 and fixed by a set screw 23 so as to form inside the head body 21 a closed space housing the sheathed cables 2 led out from the sheathed cable 3 of the well logging cable 1.

The armor steel wires 4 of the well logging cable 1 introduced from above into the top head body 20 are fixed to the top head body 20 through an outer cone 24 and inner cone 25. The core conductors of the sheathed cables 2 led out from the well logging cable 1 are connected to the terminal section 12 of the connector 11 fit and fixed to the bottom end of the bottom head body 19. That is, the sheathed cables 2 are stored in the bottom head body 19 with parts 26 looped to give slack to the lengths of the sheathed cables 2 and are connected to the terminal section of the connector 11.

The bottom head body 19 has a sleeve 27 fit into it. Further, an O-ring 14 fit over the outer circumference of the front end of the connector 11 is made to press against the inner surface of the bottom head body 19 so as to prevent the low viscosity insulating oil 29 in the bottom head body 19 from entering the measuring device body 6.

Further, the top part of the measuring device body is fit via an O-ring 16 over the outer circumference of the bottom end of the bottom head body 19 in which the connector 11 is inserted. The inside thread of a coupling 6 fit with the bottom end of the bottom head body 19 is screwed into the measuring device body 6 so as to tightly fix the measuring device body 6 to the bottom head body 19.

A well logging cable 1 usually has glass fiber or another insulating material interposed between a large number of (for example, seven) sheathed cables 2 given resin sheaths 2*a* and has holding tape covering the sheathed cables 2 and glass fibers and other insulating materials wrapped around them to form a sheathed cable 3. Armor steel wires 4 are sometimes wrapped around the outside of the sheathed cable 3. Further, the top end of the top head body 20 has the bottom end of a helical spring 28 for protecting the well logging cable 1 fit into it.

By connecting the top and bottom head bodies 20 and 19, the inside of the head body is formed with a closed space where the sheathed cables 2 are arranged. The bottom head body 19 of this closed space is filled with a high temperature low viscosity insulating oil 29 as an insulating oil. As a lid member for preventing leakage of the low viscosity insulating oil 29 from the bottom head body 19, a movable sealing member 30 is housed in the bottom head body 19.

The movable sealing member 30 is a cylindrical member (piston member) having a predetermined length having stepped parts 31 at the top and bottom and is formed by metal or another material. Further, an O-ring 32 is fit over the outer circumference of a movable sealing member 30. This O-ring 32 can slide up and down in close contact with the inner circumference of the bottom head body 19 across a predetermined range (L) and prevents leakage upward of the low viscosity insulating oil 29 from between the movable sealing member 30 and the inner surface of the bottom head body 19.

Further, the sheathed cables 2 are passed through a through hole 33 formed passing through the thick part of the movable sealing member 30 in the axial direction. If borehole fluid enters the part at the top side of the movable sealing member 30 and the pressure difference between the top and bottom, that is, the difference between the pressure of the low viscosity insulating oil 29 and the pressure due to the borehole water, is remarkably large, the movable sealing member 30 can move up and down in the bottom head body 19 within a predetermined range (L) due to the pressure difference. The sheathed cables 2 are looped at looped parts 26 in the middle of their long lengths and stored in the bottom head body 19 with slack. When the movable sealing member 30 moves up and down, the sheathed cables 2 therefore also move together with it.

Normally, the pressure due to the borehole water at the top side of the movable sealing member 30 is much larger than the pressure of the low viscosity insulating oil at the bottom side. Therefore, when the cable connection head 18 is lowered deep into a borehole, the movable sealing member 30 which had been at the upper limit position moves downward due to the pressure difference. Due to this, it acts to reduce the pressure difference between the top and bottom sides of the movable sealing member 30.

The top and bottom stepped parts 31 of the movable sealing member 30 have boots 34 fit over them. The boots 34 are comprised of short tubes made of heat resistant rubber (Teflon (registered trademark) etc.) constricted to the illustrated shapes. These function to eliminate any clearances between the seven sheathed cables 2 led out from the top and bottom of the movable sealing member 30 and the moving sealing member 30 and to prevent entry of borehole fluid. The boots 34 slide along the inner surfaces of the top and bottom head bodies 20 together with the movable sealing member 30.

FIG. 1 and FIG. 3 show the state of the movable sealing member 30 moved to the upper limit. When the cable connection head 18 is lowered deep into a borehole, the movable sealing member 30 is set at the upper limit position and can move from that position downward by a range of the length L. That is, along with the elapse of time, the borehole water enters into the head body 21. When the pressure due to the borehole water above the movable sealing member 30 becomes larger than the pressure of the low viscosity insulating oil 29 at the bottom side, the movable sealing member moves downward by the pressure difference. FIG. 4 shows the state of the movable sealing member 30 moved downward to an intermediate position. FIG. 5 shows the state where the pressure difference at the top side and bottom side of the movable sealing member 30 becomes even larger and this pressure difference causes the movable sealing member 30 to move to the lower limit.

FIG. 6 shows the state of filling a low viscosity insulating oil 29 into the bottom head body 19. The figure shows the state with the movable sealing member 30 moved to the lower limit where air in the bottom head body 19 is driven out from a top exhaust port 36 and low viscosity insulating oil 29 is injected into the bottom head body 19 from an oil injection port 37 by an injection pump 38. Note that after filling the low viscosity insulating oil 29 in the bottom head body 19, the oil injection port 37 and exhaust port 36 are closed by the lid plate 40. The sleeve 27 is formed with an opening 41 through which the oil can flow. Note that to facilitate understanding of the explanation, FIG. 6 shows the state of standing the head body 2 vertically and filling it with a low viscosity insulating oil 29. In most cases, however the head body 21 is laid horizontally and filled with a low viscosity insulating oil 29.

At the time of use when inserting the cable connection head 18 deep into a borehole together with the measuring device, due to the pressure difference above and below the movable sealing member 30, the movable sealing member 30 moves downward, so the pressure difference above and below the movable sealing member 30 is reduced. Due to this, the movable sealing member 30 can be constructed so that it need not withstand a large pressure. Also, since the pressure difference above and below the lid member is reduced, it is possible to prevent entry of the borehole fluid to the location at the connector metal section at the bottom side of the movable sealing member over a long period of time.

The main role of preventing the entry of borehole fluid to the core conductors of the sheathed cables 2 and the metal connection part of the connector 11 is performed by the low viscosity insulating oil at the bottom side of the movable sealing member 30. The top side of the movable sealing member 30 may be an empty space, but the upper side may also contain a low viscosity insulating oil supplementarily in accordance with need (illustration omitted).

The low viscosity insulating oil 29 is preferably an oil with a specific gravity heavier than the borehole fluid so that it will not mix together with the borehole fluid and even if mixing together, will quickly separate and sink to the bottom. When selecting oil as an insulating material, one with a specific gravity heavier than water is selected. Even if left over the long term, while there may be simple leakage, the borehole fluid will not reach below (in the lid) due to gravity.

Table 1 illustrates the types of oil (in the table, insulating fluids or insulators). The "suitable" and "unsuitable" in the table indicate suitability or unsuitability for use in the low viscosity insulating oil of the present invention. In Table 1, the 1. gas oil, 2. kerosine, and 3. machine oil are not suitable for use for the present invention due to the relationship between the dynamic viscosity and specific gravity, while 4. silicone oil and 5. Krytox (registered trademark, fluorine-based oil) are suitable for use in the present invention when having specific gravities heavier than 1.0 and therefore having predetermined dynamic viscosities.

TABLE 1

List of Insulating Fluids Filled in Cable Heads

| Name | Insulator | Dynamic viscosity | Specific gravity | Suitable/ unsuitable | Remarks |
|---|---|---|---|---|---|
| 1. Gas oil | Insulator | 1.8 or more (30° C.) | 0.835 (30° C.) | Unsuitable | Specific gravity lighter than 1.0 |
| 2. Kerosine | Insulator | 1.614 (30° C.) | 0.800 (30° C.) | Unsuitable | Specific gravity lighter than 1.0 |
| 3. Machine oil | Insulator | 90 to 110 (40° C.) | 0.860 to 0.870 (30° C.) | Unsuitable | Specific gravity lighter than 1.0 |
| 4. Silicone oil | | | | | |
| KF54 | Insulator | 400 (25° C.) | 1.070 (25° C.) | Suitable | |
| HIVACF-5 | Insulator | 37 (25° C.) | 1.065 (25° C.) | Suitable | |
| HIVACF-4 | Insulator | 160 (25° C.) | 1.097 (25° C.) | Suitable | |
| 5. Krytox (registered trademark, fluorine-based oil) | | | | | |
| 143CZ | Insulator | 360 (20° C.) | 1.860 to 1.910 (24° C.) | Suitable | |
| 143AZ | Insulator | 40 (20° C.) | | Suitable | |
| 143AA | Insulator | 85 (20° C.) | | Suitable | |
| 143AY | Insulator | 150 (20° C.) | | Suitable | |

TABLE 1-continued

List of Insulating Fluids Filled in Cable Heads

| Name | Insulator | Dynamic viscosity | Specific gravity | Suitable/ unsuitable | Remarks |
|---|---|---|---|---|---|
| 143AB | Insulator | 230 (20° C.) | | Suitable | |

According to the present embodiment, as the insulator in the cable connection head body, a low viscosity insulating oil with a specific gravity heavier than water is filled instead of high viscosity grease. To prevent outflow of oil, a movable sealing member is provided inside by a piston-like mechanism. The movable sealing member prevents the entry of the borehole fluid into the head body and holds the pressure balance, so conventional trouble is eliminated and long-term measurement becomes possible. In particular, long-term earthquake measurement and continuous measurement of the pressure, temperature, or other physical properties become possible in boreholes drilled at earthquake belts, volcanic belts, or other high temperature regions.

Embodiments (1) Test Well A, set depth 483 m (borehole temperature: 120° C.)

Set period: Aug. 23, 2001 to Sep. 11, 2002 (385 days)

(2) Test Well B, set depth 1,790.7 m (borehole temperature: 135° C.)

Set period: Oct. 28, 2003 to Jan. 28, 2004 (92 days)

As a result of the tests of (1) and (2), it was possible to confirm that even if a large pressure is applied to the movable sealing member from the top side, the movable sealing member can move in a piston-like manner, so entry of borehole fluid at the movable sealing member can be prevented and smooth continuous measurement is possible.

BRIEF DESCRIPTION OF THE DRAWINGS

FIG. 1 A longitudinal sectional view of a cable connection head according to an embodiment of the present invention.

FIG. 2 (a) is a sectional view of a sheathed cable, while (b), (c), and (d) are sectional views along the lines A-A, B-B, and C-C of FIG. 1.

FIG. 3 An enlarged view of FIG. 1 providing a sectional view of the state of a movable sealing member moved to an upper limit.

FIG. 4 An enlarged view of FIG. 1 providing a sectional view of the state of a movable sealing member moved to an intermediate location.

FIG. 5 An enlarged view of FIG. 1 providing a sectional view of the state of a movable sealing member moved to a lower limit.

FIG. 6 An enlarged view of FIG. 1 providing a sectional view of the state of filling insulating oil into a cable connection head.

FIG. 7 A sectional view of a conventional cable connection head.

DESCRIPTION OF NOTATIONS

1 well logging cable
2 sheathed cable
3 sheathed cable
4 armor steel wire

5 cable connection head
6 measuring device body
7 bottom head body
8 top head body
9 O-ring
10 head body
11 connector
12 terminal
13 sleeve
14 O-ring
15 coupling
16 O-ring
17 grease
18 cable connection head
19 bottom head body
20 top head body
21 head body
22 fitting connection
23 set screw
24 outer cone
25 inner cone
26 looped part
27 sleeve
28 helical spring
29 low viscosity insulating oil
30 movable sealing member
31 step
32 O-ring
33 through hole
34 boot
35 collar
36 exhaust port
37 oil injection port
38 injection pump
40 lid plate
41 opening

The invention claimed is:

1. A structure of a cable connection head comprising a head body formed in which a bottom head body connected to a measuring device body and a top head body into which a well logging cable is introduced forming a closed space and in which cores led out from sheathed cables of the well logging cable are fixed to the bottom head body, said bottom head body housing an insulating oil preventing entry of borehole fluid and being provided with a movable sealing member preventing the insulating oil from flowing out, the insulating oil being a low viscosity insulating oil with a specific gravity heavier than the borehole fluid, and the movable sealing member being configured to be able to move in the bottom head body together with the sheathed cables passing through the movable sealing member in an axial direction due to a pressure difference above and below the sealing member.

2. The structure of a cable connection head as set forth in claim 1, wherein said movable sealing member has fit therein an o-ring that slides along an inside surface of the head body.

3. The structure of a cable connection head as set forth in claim 1, wherein said movable sealing member has a cylindrical boot fixed thereto through which the sheathed cables pass and said cylindrical boot is configured to slide along an inner circumference of a sleeve arranged at an inside of the head body.

* * * * *